US006267141B1

(12) United States Patent
Rivolier

(10) Patent No.: US 6,267,141 B1
(45) Date of Patent: Jul. 31, 2001

(54) HYDRAULIC DIRECTIONAL CONTROL VALVE

(75) Inventor: Michel Rivolier, L'Arbresle (FR)

(73) Assignee: Mannesmann Rexroth S.A., Venissieux (FR)

( * ) Notice: Subject to any disclaimer, the term of this patent is extended or adjusted under 35 U.S.C. 154(b) by 0 days.

(21) Appl. No.: 09/487,695

(22) Filed: Jan. 19, 2000

(30) Foreign Application Priority Data

Jan. 26, 1999 (FR) ..... 99 00820

(51) Int. Cl.[7] ..... F15B 13/02

(52) U.S. Cl. ..... 137/596; 91/446; 91/518; 137/596.13

(58) Field of Search ..... 91/446, 518; 137/596, 137/596.13

(56) References Cited

U.S. PATENT DOCUMENTS

| | | | | |
|---|---|---|---|---|
| 3,431,028 | * | 3/1969 | Yoder | 137/513.4 X |
| 4,256,142 | * | 3/1981 | Hancock | 137/596 |
| 4,716,933 | | 1/1988 | Stoever et al. | 137/596.2 |
| 5,305,789 | | 4/1994 | Rivolier | 137/596 |

FOREIGN PATENT DOCUMENTS 2 689 575 10/1993 (FR) .

2 121 923 1/1984 (GB) .

OTHER PUBLICATIONS

French Preliminary Search Report, dated Aug. 24, 1999, Appl. No. FR 9900820.

* cited by examiner

*Primary Examiner*—Gerald A. Michalsky
(74) *Attorney, Agent, or Firm*—Marshall, O'Toole, Gerstein, Murray & Borun

(57) ABSTRACT

A hydraulic directional control valve with a regulating balance comprising a plunger which can be displaced in a housing (13) under the action of a differential pressure (Δp) between the intake pressure (P) and the highest load pressure (LS), and which is designed to open, in proportion to this differential (Δp), a lateral orifice of the housing linked to a working orifice (A, B) of the directional control valve; the wall of the housing and/or the plunger is provided with a calibrated passage linking the intake of fluid at pressure (P) and the lateral orifice when the plunger is pushed back into an end position by the pressure (LS) exceeding the intake pressure (P); consequently, in spite of the excess value of the pressure (LS) intended to inhibit operation of the directional control valve, hydraulic fluid is delivered to the lateral orifice at a low rate and allows the hydraulic receiver controlled by the hydraulic directional control valve to be displaced at a low rate.

5 Claims, 3 Drawing Sheets

HYDRAULIC DIRECTIONAL CONTROL VALVE

BACKGROUND OF THE INVENTION

The present invention relates to improvements made to hydraulic directional control valves having a regulating balance designed to sense the highest load pressure, assume an anti-saturation function and provide a function whereby the flow is split independently of the load, this balancing system comprising a plunger that can be displaced in a housing under the action of a differential pressure created by the intake pressure supplied by a hydraulic source applied to a first of its ends and by the highest load pressure applied to its other end, said plunger also being designed to open, in is proportion to the above-mentioned differential pressure, a lateral orifice of the housing connected to a working orifice of the directional control valve in order to apply hydraulic fluid thereto at the intake pressure less said differential pressure.

By way of example, FIG. 1 of the appended drawings illustrates in cross-section a known mode of operating such a directional control valve as disclosed in FIG. 1 of document FR-A 2 689 575.

The directional control valve has a body 1 provided with an orifice P for admitting pressurised fluid from a hydraulic source (not illustrated). In the example illustrated, said orifice P is provided in the form of a passage 2 crossing through the body 1, transversely to the plane of the drawing, and opening at the two main faces of said body, which acts as a support when several directional control valves are stacked side by side and one against the other. At least one orifice T (provided in the form of a passage crossing through the body 1 transversely to the plane of the drawing and opening at the two main faces of said body) is used to return the fluid to a tank (not illustrated). Two working orifices A, B can be connected to a hydraulic device or receiver (not illustrated). A slide valve 4 is designed to slide in a bore 5 which crosses longitudinally through the body 1 and opens at two opposing end faces 6, 7 thereof. In a conventional manner, the body 1 and the slide valve 4 have passages and/or ducts and/or grooves arranged so as to co-operate, with a view to establishing and/or cutting off the links between the various orifices P, A, B, T of the body of the directional control valve depending on the axial position occupied by the slide valve in the bore. The specific layout of these passages and/or ducts and/or grooves is determined by the person skilled in the art depending on the functions which the is directional control valve is required to perform.

In this specific example, the body 1 also has another transverse passage 8 extending between the main faces of the body and combined with at least one pressure selector, which enables the higher (load sensing pressure or LS pressure) of two pressures, these being the pressure in said passage upstream of the directional control valve and the working pressure of the directional control valve respectively, to be applied to a passage 18 located downstream of the slide valve 4.

In the bore 5 of the body, the passage 2 connected to the intake orifice P opens into an admission chamber 10 thereof, adjacent to which is another chamber 11 communicating via a passage 12 with a housing 13 in which a freely and tightly sliding plunger 14 is mounted. The passage 12 opens into the housing 13, at one end thereof, in this case the bottom end (corresponding to an end face of the plunger 14, in this case its bottom end) whilst at its opposite end (in this case its top end) the housing 13 opens into a cavity 15 in which the head

16 of the plunger 14 may be displaced. The head 16, which is wider than the body of the plunger, may bear on a shoulder provided at the point where the housing 13 opens into the cavity 15 in order to retain the plunger 14. A spring 17 is provided in the cavity 15 to push the plunger 14 back against said shoulder in order to fix its position in the absence of pressure. The above-mentioned passage 8 opens into the cavity 15 so that the pressure prevailing in the passage 8 is also present in the cavity 15 and hence applied to the corresponding end of the plunger 14 (in this case its top end).

In addition, the plunger 14 has passing through it an axial passage 18, opening at one end in its end face facing the passage 12 and at the other end in a diametral passage 19 crossing through the plunger 14 and arranged so that it is closed off by the wall of the housing 13 when the plunger 14 is in the rest position imposed by the spring 17 (illustrated in FIG. 1) or in a not fully raised position. A part 28 of the axial passage 18 is provided in the form of a restriction or a nozzle.

The portion of the slide valve 4 which, in the neutral position, extends between the chambers 10 and 11 isolating them from one another is provided with graded notches 20 designed to ensure that the hydraulic fluid flows in a controlled manner in the relevant direction when the slide is displaced in one direction or the other.

Extending from the housing 13 in two approximately diametrically opposed directions are two conduits 21, in one of which or in each of which a non-return valve 22 is arranged, the two conduits 21 opening, in the bore 5, into two respective chambers 23.

Close to the chambers 23, two respective distribution chambers 24 of the bore 5 are linked by conduits 25 to the respective working orifices or initial orifices A and B of the directional control valve.

Finally, beyond the distribution chambers 24, two return chambers 26 of the bore 5 are respectively linked by conduits 27 to the return passage 3 opening onto the return orifice T.

The way in which the directional control valve described above works is explained in detail in document FR 2 689 575, mentioned above, to which reference may be made.

Although a directional control valve of the design outlined above is satisfactory in terms its general operating principle, it nevertheless has a disadvantage under certain operating conditions. A directional control valve of this type is not designed to be used alone but to work in co-operation with several directional control valves of the same type to make up a multiple hydraulic directional control system. This being the case, the directional control valves are preferably stacked tightly one against the other by their main faces or large faces so that the respective conduits P, T and LS (passages 8) all communicate with one another and form continuous passages crossing through the stack from end to end, enabling the multiple directional control device to work.

In a multiple directional control device of this type, if operation of one particular distribution section (i.e. an individual directional control valve) is inhibited due to the action of a pressure LS imposed by another section of the multiple directional control device, it may nevertheless be desirable for that particular distribution section to be allowed to continue in operation so that the hydraulic receiver which it controls can be placed or maintained in operation, albeit at a reduced rate: this might be the case if a machine turret has to be rotated or a machine moved in translation, for example.

In other words, it would seem desirable to be able to impart an operating capability to a specific function, albeit at a lesser or downgraded rate, in spite of the controlled inhibiting action imposed by the general LS circuit of the multiple directional control device, and to do so without having to use a priority circuit for the specific section in question, examples of this being known, given that the use of such, which complicates the overall design and adds to the cost, does not seem to be called for in the context in question.

Accordingly, what is needed is to give the specific distribution section in question a pseudo-priority without substantially modifying the individual directional control valve or the multiple directional control device.

SUMMARY OF THE INVENTION

The objective of the invention, therefore, is to propose an improved design which meets the needs of users whilst requiring only minimal adjustments to the structures of existing directional control valves.

With these aims in mind, the invention proposes a hydraulic directional control valve as defined in the preamble, which is characterised in that the wall of the housing and/or the plunger is provided, in a zone in the vicinity of the above-mentioned first end of the plunger, with at least one calibrated passage, designed to establish a link between the above-mentioned first end of the plunger and the above-mentioned lateral orifice when the plunger is pushed back into an end position under the action of the highest load pressure exceeding the intake pressure.

As a result of this arrangement, when the highest load pressure exceeds the intake pressure and pushes the plunger back into an end position intended to cut off the flow of hydraulic fluid from the intake orifice to the lateral orifice of the housing—thereby inhibiting operation of the directional control valve in favour of another directional control valve of the multiple directional control device controlling a hydraulic receiver building up the highest load pressure—the presence of the calibrated passage nevertheless allows a flow of hydraulic fluid to be maintained at a low rate to the lateral orifice: the hydraulic receiver associated with the directional control valve can then continue to be supplied and will continue to function, albeit at a reduced rate.

The presence of the calibrated passage means that the reference pressure regulating the balance of the directional control valve is no longer exactly the differential pressure $\Delta p$ existing between the intake pressure (P) and the highest load pressure (LS) as carried in the line LS and applied to the first end of the plunger.

Consequently, a pseudo-priority is established in favour of the hydraulic receiver controlled by the directional control valve of this design and this receiver can continue to function at a low rate.

Although, from a functional point of view, the calibrated passage may be provided either in the wall of the housing or in the plunger, it is nevertheless of greater advantage to machine the calibrated passage in the plunger, which makes the machining process easier.

By preference, several calibrated passages may be provided, distributed, advantageously at regular intervals, around the periphery.

In one simple embodiment, each passage is provided in the form of a notch, hollowed into the wall. However, it may be provided as a passage with a calibrated restriction .

BRIEF DESCRIPTION OF THE DRAWINGS

The invention will be more readily understood from the detailed description of certain embodiments below, which are given merely as examples and are not restrictive in any respect. Throughout the description, reference will be made to the appended drawings, in which.

DETAILED DESCRIPTION OF THE INVENTION

Figure 1:
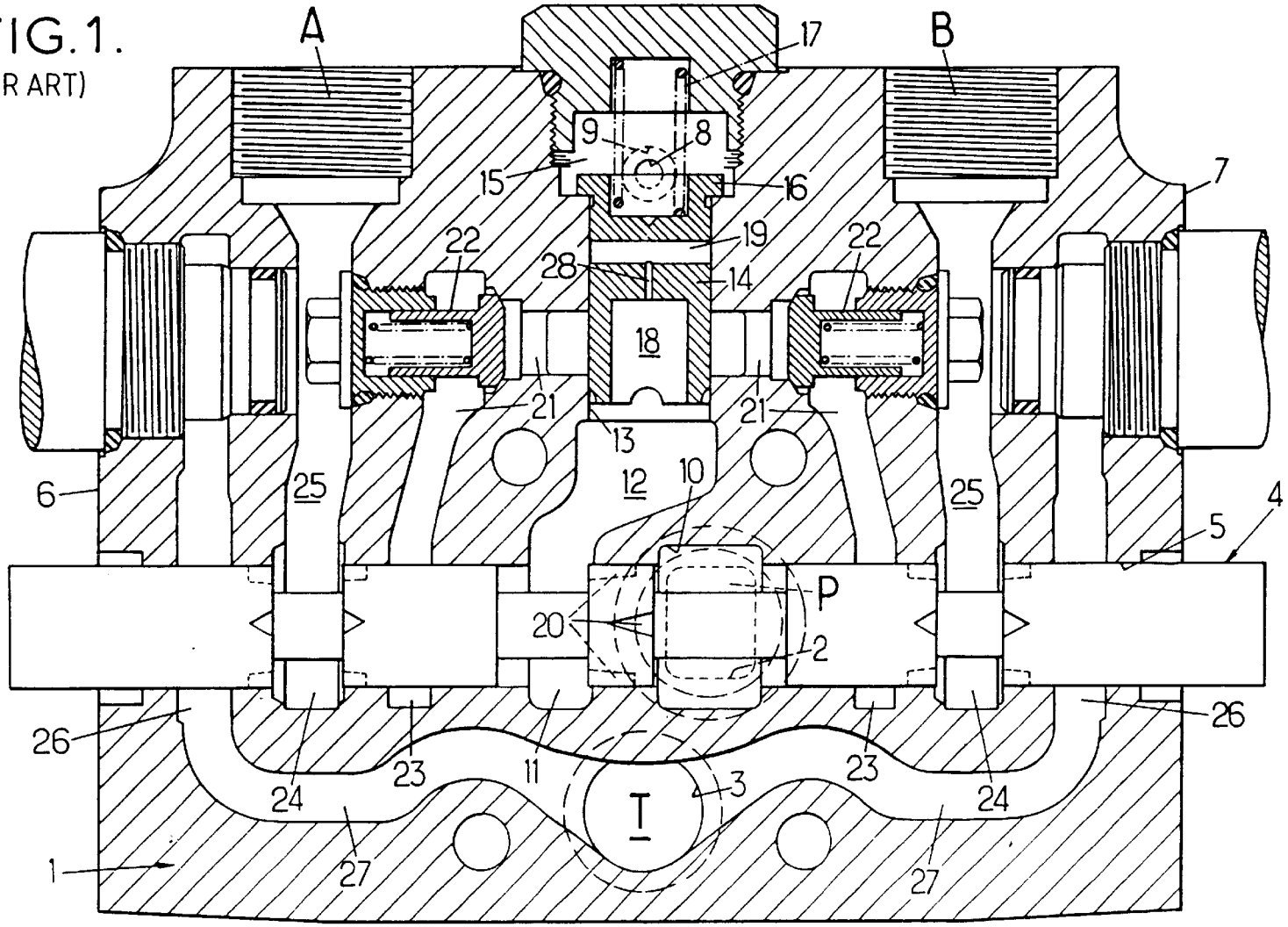
FIG. 1. (PRIOR ART)
FIG. 1 comprises a sectional view of a prior art directional; control valve.
Figure 2:
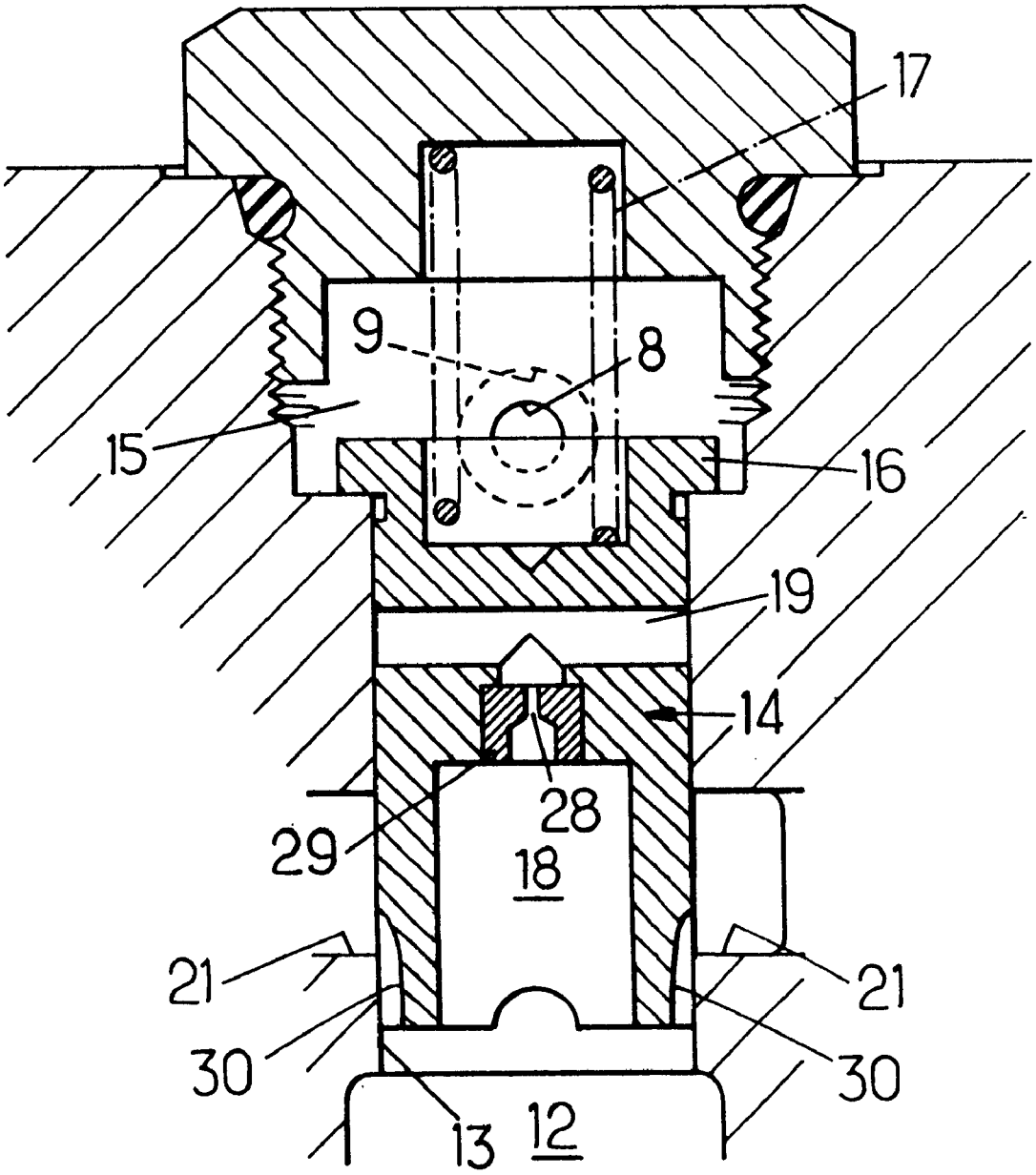
FIG. 2 provided a partial view in section and on an enlarged scale, of a part of the directional control valve illustrated in FIG. 1 and showing a preferred embodiment of the layout proposed by the invention.

Turning firstly to FIG. 2, where the same reference numerals are used to denote components common to FIG. 1, a regulating balance such as that used with the directional control valve illustrated in FIG. 1 is shown in an enlarged view, the only difference being that in this case the restriction provided in the passage 18 is provided in an insert 29 placed in the plunger 14.

The design proposed by the invention consists in providing, between the passage 12 receiving fluid at the intake pressure P and the conduit 21 linked to a working orifice A, B, a permanent calibrated passage which will ensure that fluid will flow at a low rate if the plunger 14 is pushed back into a position in which operation of the directional control valve is inhibited under the action of a higher load pressure LS prevailing in the upper chamber 15 which exceeds the intake pressure P (situation illustrated in FIG. 2).

In the preferred embodiment illustrated in FIG. 2, several calibrated passages 30 are provided in the plunger 14, distributed around the periphery and, in this case, in the form of notches hollowed into the external wall of the plunger extending parallel with the axis thereof. This is a simple embodiment from a structural point of view and requires only minimal machining of no particular technical difficulty. It should be pointed out on this subject that not only can such notches be provided on new components as they are manufactured but may also be made in existing equipment so as to give them the added pseudo-priority function described above.

Other embodiments are also conceivable.

Figure 3:
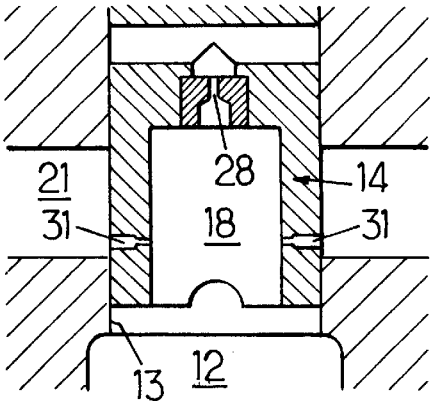
FIGS. 3 to 5 show partial views in section of a part of the balance illustrated in FIG. 2 and depict respectively several possible variants of the design proposed by the invention.

In FIG. 3, the calibrated passages 31 are provided in the form of radial passages with a restricted section, which can be made without any major difficulty from a manufacturing point of view.

Figure 4:
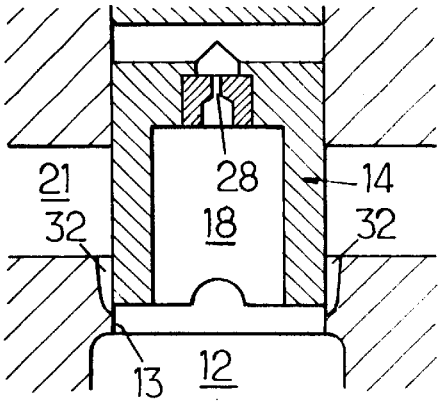
Figure 5:
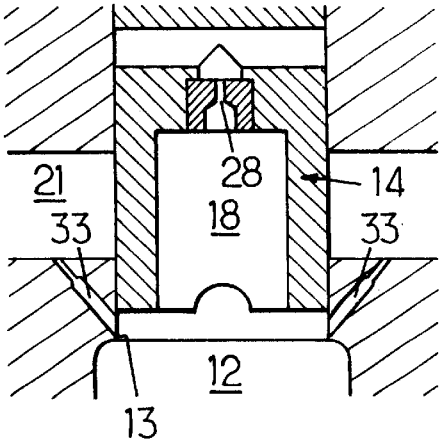

In FIGS. 4 and 5, the calibrated passages are provided in the wall of the housing 13, linking the passage 12 and the conduit 21, either in the form of notches 32 hollowed into the wall of the housing 13 on a level with the bottom end of the plunger 14 (FIG. 4) or in the form of passages with a restricted section 33 (FIG. 5) hollowed into the body 1 of the directional control valve behind the surface of the housing 13.

In the context of standard single-block bodies, however, the designs illustrated in FIGS. 4 and 5 may give rise to manufacturing problems, given that the areas to be machined are not readily accessible.

What is claimed is:

1. A hydraulic directional control valve having a regulating balance designed to provide a highest load-pressure sensing function, an anti-saturation function and a function whereby the flow is split independently of the load, this balance comprising a plunger which can be displaced in a housing under the action of a differential pressure (Δp) created by the intake pressure (P) supplied by a hydraulic source and applied to a first of its ends and by the highest load pressure (LS) applied to its other end, said plunger also being designed to open, in proportion to said differential pressure (Δp), a lateral orifice of the housing linked to a working orifice of the directional control valve so as to deliver the hydraulic fluid to it at the intake pressure (P) less said differential pressure (Δp), characterised in that a wall of the housing or the plunger is provided, in a zone arranged in the vicinity of said first end of the plunger, with at least one calibrated passage designed to establish a link between said first end of the plunger and said lateral orifice when the plunger is pushed back into an end position under the action of the highest load pressure (LS) exceeding the intake pressure (P), as a result of which, in spite of the excess value of the highest load pressure (LS) intended to inhibit operation of the directional control valve, hydraulic fluid is nevertheless delivered at a low rate to the lateral orifice and allows a hydraulic receiver controlled by said hydraulic directional control valve to be displaced at a low rate.

2. A hydraulic directional control valve as claimed in claim 1, characterised in that the calibrated passage is provided on the plunger.

3. A hydraulic directional control valve as claimed in claim 1, characterised in that several peripherally distributed calibrated passages are provided.

4. A hydraulic directional control valve as claimed in claim 1, characterised in that each calibrated passage is provided in the form of a notch hollowed into the wall.

5. A hydraulic directional control valve as claimed in claim 1, characterised in that each calibrated passage is provided in the form of a passage with a calibrated restriction.

* * * * *